US006440919B1

(12) United States Patent
Kerobo et al.

(10) Patent No.: US 6,440,919 B1
(45) Date of Patent: Aug. 27, 2002

(54) AQUEOUS BASED SOLVENT FREE CLEANER COMPOSITIONS CONTAINING TWO NONIONIC SURFACTANTS

(75) Inventors: Charles O. Kerobo, Southfield; Michael C. Welch, Woodhaven; Suzanne M. Gessner, Ypsilanti; Sonia J. Patterson, Detroit, all of MI (US)

(73) Assignee: BASF Corporation, Mount Olive, NJ (US)

( * ) Notice: Subject to any disclaimer, the term of this patent is extended or adjusted under 35 U.S.C. 154(b) by 0 days.

(21) Appl. No.: 09/603,416

(22) Filed: Jun. 26, 2000

Related U.S. Application Data

(62) Division of application No. 08/902,495, filed on Jul. 29, 1997, now Pat. No. 6,133,218.

(51) Int. Cl.[7] ..... C11D 1/825; C11D 3/37

(52) U.S. Cl. ..... 510/365; 510/218; 510/245; 510/280; 510/422; 510/476; 510/508; 510/421; 510/514; 510/535

(58) Field of Search ..... 510/365, 218, 510/245, 280, 422, 476, 506, 421, 514, 535

(56) References Cited

U.S. PATENT DOCUMENTS

| | | | | | |
|---|---|---|---|---|---|
| 5,501,816 | A | * | 3/1996 | Burke et al. | 252/174.21 |
| 5,821,213 | A | * | 10/1998 | Burke et al. | 510/365 |
| 5,880,082 | A | * | 3/1999 | Welch et al. | 510/365 |
| 5,958,859 | A | * | 9/1999 | Welch et al. | 510/365 |
| 5,958,860 | A | * | 9/1999 | Welch et al. | 510/365 |
| 5,965,509 | A | * | 10/1999 | Welch et al. | 510/365 |
| 5,977,048 | A | * | 11/1999 | Welch et al. | 510/365 |
| 6,133,218 | A | * | 10/2000 | Kerobo et al. | 510/365 |

* cited by examiner

*Primary Examiner*—Yogendra N. Gupta
*Assistant Examiner*—Brian P. Mruk
(74) *Attorney, Agent, or Firm*—David T. Banchik

(57) ABSTRACT

The present invention relates to an aqueous based, solvent free degreaser composition, comprising a blend of two nonionic surfactants selected from, alcohol alkoxylate with a fatty alcohol moiety alkoxlyate, fatty alkoxlyated alcohol, fatty alcohol having oxyethylate moieties, polyoxyalkylene block copolymers, and alkyl phenol alkoxylate.

1 Claim, No Drawings

AQUEOUS BASED SOLVENT FREE CLEANER COMPOSITIONS CONTAINING TWO NONIONIC SURFACTANTS

This Application is a division of application Ser. No. 08/902,495 filed Jul. 29, 1997, now U.S. Pat. No. 6,133,218.

FIELD OF THE INVENTION

The present invention relates to an aqueous based solvent free degreaser composition comprising two nonionic surfactant components which effectively clean oils and greases from a variety of surfaces.

BACKGROUND OF THE INVENTION

The demand for degreasing formulations for a myriad of cleaning applications is well known. Target applications range from the light cleaning of printed electronic circuit boards to the cleaning of used automotive parts. Many formulations for these purposes contain varied levels of volatile solvents to efficiently degrease surfaces. Many heavy duty degreasing operations use heated solvent baths.

Recent concerns for environmental and toxicological effects of solvents and solvent baths have caused a full search for aqueous degreasing systems without solvent. Few surfactant based systems have been successful without at least a minor amount of solvent, for the dual purpose of cleaning and defoaming. Hence, industrial and institutional cleaning operations that require degreasing must reconcile their desire to be socially conscious with the need to remain effective.

The use of glycol ether solvents or cycloalkanes in cleaning compositions, in combination with anionic and/or nonionic surfactants, are known in the art. Examples of such systems may be found in Wittel et al., EP 376367; Kao Corporation, JP 3062896; Lyubarskay et al., SU 1300041; Bedo et al., SU T56873; and Dudesek et al., CS 220985.

Bobsein, et al, U.S. Pat. No. 4,663,082, teach a high pH water based industrial cleaning composition comprising a series of anionic surfactants, builders and alkalinity agents. In addition, the patentees teach the use of phosphate builders and chelating agents.

Henkel AG World Organization Patent No. 91/10718 discloses a composition requiring at least one anionic surfactant and at least one monocarboxylic acid. European Patent No. 0392394B1 issued to the Nippon Paint Co. of Japan teaches a degreasing composition and a surfactant package comprising a nonionic surfactant of the polyoxyalkylene ether type with a phosphate polyethylene oxide adduct. This mix is combined with a necessary amount of alkali builder of varying types. However, the phosphate moiety is responsible for increasing the generation of foam. Finally, residual phosphorous is an environmental concern. The nominal amount of alkali builder also results in a caustic solution.

Further, European Patent No. 0084411A1 assigned to Albright & Wilson Limited teaches the use of a wide variety of nonionic surfactants or a phosphate ester with an alkanolamide and solvent U.S. Pat. No. 5,536,438, discloses a cleaning composition containing four nonionic surfactants (fatty alcohol ethoxylates) of different HLB values; U.S. Pat. No. 5,518,648 discloses a dishwashing composition comprising 2 nonionic surfactants of the alcohol alkoxylate type and a block copolymer of EO/PO; U.S. Pat. No. 5,382,376, discloses a detergent composition comprising: (a) EO/PO/EO block copolymer, (b) cosurfactants such as EO/PO/EO block copolymers with a hydrophobic moiety, (c) hydrophobic solvents such as alkylbenzenes; U.S. Pat. No. 5,049,376 discloses a detergent composition comprising surfactants selected from anionic, zwitterionic, cationic and nonionic; non phosphate builders, EO/PO block copolymers, and a polycarboxylate polymer.

Finally, U.S. Pat. No. 5,501,816 (US '816) discloses ternary surfactant blends comprising: alcohol alkoxylate with a fatty alcohol moiety, alkyl phenol alkoxylates and alkyl oxyethylate. US '816 also discloses that the addition of polycarboxylate polymers enhances the efficacy of the degreaser compositions.

Applicants have surprisingly discovered a diblend cleaning composition that provides safe and effective cleaning power. Further, the present invention does not require the use of polkycarboxylates to enhance cleaning efficacy.

SUMMARY OF THE INVENTION

An aqueous based solvent free degreaser composition comprising two nonionic surfactant components, wherein said two nonionic surfactant components are selected from the group consisting of:

1. 0.15%–5% of an alcohol alkoxylate with a fatty alcohol moiety having the formula:

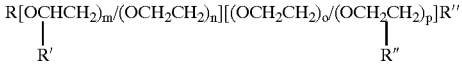

wherein R is a $C_8$ to $C_{18}$ branched or straight chain alkyl group, m is within the range of about 0 to 14, n is within the range of about 0 to 14, o is within the range of about 0 to 14, p is within the range of about 0 to 14, and R' is —$CH_3$, —$CH_2CH_3$, and mixtures thereof, R" is —$CH_3$, —$CH_2CH_3$, and mixtures thereof, and R'" is —OH, —$CH_3$, —O-$C_3$–$C_{18}$ hydroxyalkyl group and mixtures thereof; or 2. 0.15%–5% of a an alcohol fatty alcohol moiety alkoxylate with having the formula:

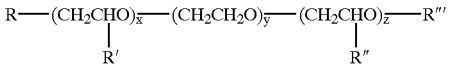

wherein R is a $C_8$ to $C_{18}$ branched or straight chain alkyl group, x is within the range of about 0 to 14; y is within the range of about 3 to 14; z is within the range of about 0 to 20; R' is —$CH_3$, —$CH_2CH_3$, and mixtures thereof, R" is —$CH_3$, —$CH_2CH_3$, and mixtures thereof, and R'" is —OH, —$CH_3$, —O-$C_3$–$C_{18}$ hydroxyalkyl group and mixtures thereof; or 3. 0.15%–5% of a fatty alcohol having oxyethylate moieties having the Formula:

$$R(OCH_2CH_2)_xOH$$

wherein R=$C_{10}$–$C_{13}$ branched or straight chain alkyl group and x is within the range of about 4 to 10; or 4. 0.15%–5% of a nonionic surfactant characterized as a block or heteric/block polyoxyalkylene polymer having a cloud point in a 1 weight percent aqueous solution of about 15° C. to about 25° C. having the Formula I:

$$Y[(EO/A)_m(A)_nH]_x \quad (I)$$

wherein, Y represents the nucleus of an active hydrogen-containing organic compound having a functionality of x and (1) about 2 to about 6 carbon atoms and 2 to 3 reactive hydrogen atoms or (2) about 6 to about 18 carbon atoms and 1 to 3 reactive hydrogen atoms; A represents a lower alkylene oxide selected from the group consisting of propylene oxide, butylene oxide, tetrahydrofuran or mixtures thereof wherein up to 25 percent by weight of A is reacted directly with said organic compound in admixture with ethylene oxide in Formula I and 75 percent by weight or more of A is subsequently reached to produce said polymer; m is within the range of about 0 to 110, and n is within the range of about 0 to 26, wherein further, the molecular weight range is from about 1,000 to 20,000, or 5. 0.15%–5% of a nonionic surfactant characterized as a block or heteric/block polyoxyalkylene having a cloud point in a 1 weight percent aqueous solution of about 15° C. to about 25° C. having the Formula II:

$$Y[(A)_o(EO)_m(A)_nH]_x \quad \text{(II)}$$

wherein, Y represents the nucleus of an active hydrogen-containing organic compound having a functionality of x and (1) about 2 to about 6 carbon atoms and 2 to 3 reactive hydrogen atoms or (2) about 6 to about 18 carbon atoms and 1 to 3 reactive hydrogen atoms; A represents a lower alkylene oxide selected from the group consisting of propylene oxide, butylene oxide, tetrahydrofuran or mixtures thereof wherein up to 25 percent by weight of A is reacted directly with said organic compound alone in Formula II and 75 percent by weight or more of A is subsequently reached to produce said polymer; o is within the range of about 0 to 26, m is within the range of about 0 to 110, and n is within the range of about 0 to 26, wherein further, the molecular weight range is from about 1,000 to 20,000, or 6. 0.15%–5% of a nonionic surfactant characterized as a block or heteric/block polyoxyalkylene having a cloud point in a 1 weight percent aqueous solution of about 15° C. to about 25° C. having the Formula III:

$$Y[(A)_o(EO/A)_m(A)_nH]_x \quad \text{(III)}$$

wherein, Y represents the nucleus of an active hydrogen-containing organic compound having a functionality of x and (1) about 2 to about 6 carbon atoms and 2 to 3 reactive hydrogen atoms or (2) about 6 to about 18 carbon atoms and 1 to 3 reactive hydrogen atoms; A represents a lower alkylene oxide selected from the group consisting of propylene oxide, butylene oxide, tetrahydrofuran or mixtures thereof wherein up to 25 percent by weight of A is reacted directly with said organic compound alone in Formula and III and 75 percent by weight or more of A is subsequently reached to produce said polymer; o is within the range of about 0 to 26, m is within the range of about 0 to 110, and n is within the range of about 0 to 26, wherein further, the molecular weight range is from about 1,000 to 20,000, or 7. 0.15%–5% of an alkyl phenol alkoxylate having the formula:

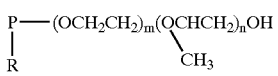

wherein P is phenyl group, R is a $C_8$ or $C_9$ branched or straight chain alkyl group, m is within the range of about 3 to 12, and n is within the range of about 0 to 12. Preferably the oxyethylate range or value of m will range from about 3 to 12 moles, and more preferably desirably from about 8 to 12 moles. Other oxyalkylation may be incorporated as desired.

The above formulation may optionally also contain about 0.005 to 1% of at least one polycarboxylate polymer of the following formula:

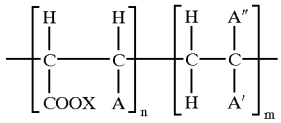

wherein x=H, Na or similar alkali or alkaline metal, A=H, COOH, COONa or similar salts, A' is COOH, COONa, or similar salts, or —$OCH_3$ or an alkyl group having a chain length of about 4 to 20 carbon atoms, A"=H or $CH_3$, and m and n are numbers such that the monomer ratio is within the range of about 10:1 to 1:10 and the total molecular weight of the polymer is within the range of about 1,000 to 70,000.

DETAILED DESCRIPTION

An aqueous based solvent free degreaser composition comprising two nonionic surfactant components, wherein said two nonionic surfactants are selected from the group consisting of:

1. 0.15%–5% of an alcohol alkoxylate with a fatty alcohol moiety having the Formula:

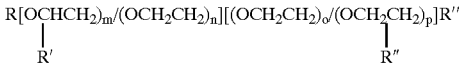

wherein R is a $C_8$ to $C_{18}$ branched or straight chain alkyl group, m is within the range of about 0 to 14, n is within the range of about 0 to 14, o is within the range of about 0 to 14, p is within the range of about 0 to 14, and R' is —$CH_3$, —$CH_2CH_3$, and mixtures thereof, R" is —$CH_3$, —$CH_2CH_3$, and mixtures thereof, and R'" is —OH, —$CH_3$, —O-$C_3$–$C_{18}$ hydroxyalkyl group and mixtures thereof; or 2. 0.15%–5% of a an alcohol alkoxylate with fatty alcohol moiety having the formula:

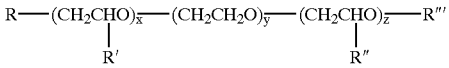

wherein R is a $C_8$ to $C_{18}$ branched or straight chain alkyl group, x is within the range of about 0 to 14; y is within the range of about 3 to 14; z is within the range of about 0 to 20; R' is —$CH_3$, —$CH_2CH_3$, and mixtures thereof, R" is —$CH_3$, —$CH_2CH_3$, and mixtures thereof, and R'" is —OH, —$CH_3$, —O-$C_3$–$C_{18}$ hydroxyalkyl group and mixtures thereof; or 3. 0.15%–5% of a fatty alcohol having oxyethylate moieties having the Formula:

$$R(OCH_2CH_2)_xOH$$

wherein R=$C_{10}$–$C_{13}$ branched or straight chain alkyl group and x is within the range of about 4 to 10, or 4. 0.15%–5% of a nonionic surfactant characterized as a block or heteric/block polyoxyalkylene polymer having a cloud point in a 1 weight percent aqueous solution of about 15° C. to about 25° C. having the Formula I:

$$Y[(EO/A)_m(A)_nH]_x \quad \text{(I)}$$

wherein, Y represents the nucleus of an active hydrogen-containing organic compound having a functionality of x and (1) about 2 to about 6 carbon atoms and 2 to 3 reactive hydrogen atoms or (2) about 6 to about 18 carbon atoms and 1 to 3 reactive hydrogen atoms; A represents a lower alkylene oxide selected from the group consisting of propylene oxide, butylene oxide, tetrahydrofuran or mixtures thereof wherein up to 25 percent by weight of A is reacted directly with said organic compound in admixture with ethylene oxide in Formula I and 75 percent by weight or more of A is subsequently reached to produce said polymer; m is within the range of about 0 to 110, and n is within the range of about 0 to 26, wherein further, the molecular weight range is from about 1,000 to 20,000, or 5. 0.15%–5% of a nonionic surfactant characterized as a block or heteric/block polyoxyalkylene polymer having a cloud point in a 1 weight percent aqueous solution of about 15° C. to about 25° C. having the Formula II:

$$Y[(A)_o(EO)_m(A)_nH]_x \quad \text{(II)}$$

wherein, Y represents the nucleus of an active hydrogen-containing organic compound having a functionality of x and (1) about 2 to about 6 carbon atoms and 2 to 3 reactive hydrogen atoms or (2) about 6 to about 18 carbon atoms and 1 to 3 reactive hydrogen atoms; A represents a lower alkylene oxide selected from the group consisting of propylene oxide, butylene oxide, tetrahydrofuran or mixtures thereof wherein up to 25 percent by weight of A is reacted directly with said organic compound alone in Formula II and 75 percent by weight or more of A is subsequently reached to produce said polymer; o is within the range of about 0 to 26, m is within the range of about 0 to 110, and n is within the range of about 0 to 26, wherein further, the molecular weight range is from about 1,000 to 20,000, or 6. 0.15%–5% of a nonionic surfactant characterized as a block or heteric/block polyoxyalkylene polymer having a cloud point in a 1 weight percent aqueous solution of about 15° C. to about 25° C. having the Formula III:

$$Y[(A)_o(EO/A)_m(A)_nH]_x \quad \text{(III)}$$

wherein, Y represents the nucleus of an active hydrogen-containing organic compound having a functionality of x and (1) about 2 to about 6 carbon atoms and 2 to 3 reactive hydrogen atoms or (2) about 6 to about 18 carbon atoms and 1 to 3 reactive hydrogen atoms; A represents a lower alkylene oxide selected from the group consisting of propylene oxide, butylene oxide, tetrahydrofuran or mixtures thereof wherein up to 25 percent by weight of A is reacted directly with said organic compound alone in Formula and III and 75 percent by weight or more of A is subsequently reached to produce said polymer; o is within the range of about 0 to 26, m is within the range of about 0 to 110, and n is within the range of about 0 to 26, wherein further, the molecular weight range is from about 1,000 to 20,000, or 7. 0.15%–5% of an alkyl phenol alkoxylate having the Formula:

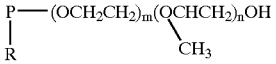

wherein P is phenyl group, R is a $C_8$ or $C_9$ branched or straight chain alkyl group, m is within the range of about 3 to 12, and n is within the range of about 0 to 12. Preferably the oxyethylate range or value of m will range from about 3 to 12 moles, and more preferably desirably from about 8 to 12 moles. Other oxyalkylation may be incorporated as desired.

The above formulation may optionally also contain about 0.005 to 1% of at least one polycarboxylate polymer of the following Formula:

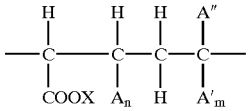

wherein x=H, Na or similar alkali or alkaline metal, A=H, COOH, COONa or similar salts, A' is COOH, COONa, or similar salts, or —$OCH_3$ or an alkyl group having a chain length of about 4 to 20 carbon atoms, A"=H or $CH_3$, and m and n are numbers such that the monomer ratio is within the range of about 10:1 to 1:10 and the total molecular weight of the polymer is within the range of about 1,000 to 70,000.

Preparation of the Degreaser Composition of the Present Invention

The cleaning composition of the present invention is prepared by blending any two of components (1), (2), (3), (4), (5), (6), or (7) according to methods known to those skilled in the art. These components are also known as non ionic surfactants.

1. The Alcohol Alkoxylate With a Fatty Alcohol Moiety

The alcohol alkoxylate with a fatty alcohol moiety has the following Formula:

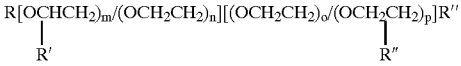

wherein R is a $C_8$ to $C_{18}$ branched or straight chain alkyl group, m is within the range of about 0 to 14, n is within the range of about 0 to 14, o is within the range of about 0 to 14, p is within the range of about 0 to 14, and R' is —$CH_3$, —$CH_2CH_3$, and mixtures thereof, R" is —$CH_3$, —$CH_2CH_3$, and mixtures thereof, and R'" is —OH, —$CH_3$, —O-$C_3$–$C_{18}$ hydroxyalkyl group and mixtures thereof. R'" can be, for example, —O-$C_4$ $H_9$. In a preferred embodiment, the oxyethylate level or value of n plus o will range from about 5 to 12, and even more preferably from about 4 to 10. The oxypropylate level or value of m plus p will preferably be about 4 to 14. Those skilled in the art may find that butylene oxide may also be incorporated into the alcohol alkoxylate.

A preferred alcohol alkoxylate with a fatty alcohol moiety has a carbon chain (R) of $C_{12-15}$ with approximately 10 moles total of oxyethylate and approximately 5 moles total of oxypropylate, where m=1.5, n=1, o=9, and p=3.5. Another preferred alcohol alkoxylate with a fatty alcohol moiety is has a C8-10 carbon chain length (R) with approximately 10 moles oxyethylate and approximately 14 moles oxypropylate, wherein n=1, o=9, m=7, and p=7.

The alcohol alkoxylate with a alkoxylated fatty alcohol moiety will make up about 0.15 to 5.0% by weight of the total degreaser composition. More preferably, this component will comprise about 0.17 to 3.3% by weight of the total composition, and even desirably will be present in an amount of about 0.5 to 2% by weight of the total formulation.

2. The Alkoxylated Fatty Alcohol Component

The alkoxylated fatty alcohol component has the following Formula:

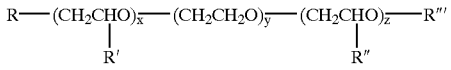

wherein R is a $C_8$ to $C_{18}$ branched or straight chain alkyl group, x is within the range of about 0 to 14; preferably 1 to 10; most preferably 1 to 6; y is within the range of about 3 to 20, preferably 3 to 10, most preferably 3 to 6; z is within the range of about 0 to 20, preferably 3 to 10, most preferably 3 to 5; R' is —$CH_3$, —$CH_2CH_3$, and mixtures thereof, R" is —$CH_3$, —$CH_2CH_3$, and mixtures thereof, and R'" is H, —OH, —$CH_3$, —O-$C_3$–$C_{18}$ hydroxyalkyl group and mixtures thereof. Preferably, R'=$CH_3$ and $CH_2CH_3$, R"=$CH_3$ and $CH_2CH_3$, and R'"=H, $C_{8-18}$ hydroxyalkyl group. More preferably, x=0, R"=$CH_2CH_3$, and R'"=H.

The preferred alkoxylated fatty alcohol component, which has a $C_{16-18}$ carbon chain length (R) with approximately four moles of oxyethylate and approximately nine moles of oxypropylate. The most preferred fatty alcohol component has a $C_{9-11}$ carbon chain length (R) with approximately nine moles of oxyethylate and one mole of oxybutylate.

The alkoxylated fatty alcohol component will comprise about 0.15 to 5% by weight of the total degreaser composition. More preferably, this component will comprise about 0.17 to 3.3% by weight of the total composition, and most preferably in an amount of about 0.5–2% by weight of the total formulation.

3. The Fatty Alcohol Having Oxyethylate Moieties Component

The fatty alcohol having oxyethylate moieties has the following Formula:

$$R(OCH_2CH_2)_xOH$$

wherein R is a $C_{10}$ to $C_{13}$ branched or straight chain alkyl group and x is within the range of about 4 to 10.

Preferred fatty alcohols having oxyethylate moieties are available from BASF Corporation, Mt. Olive, N.J., under the tradename ICONOL™ TDA 10, wherein R=13 and x=10 and ICONOL™ DA 4, wherein R=10 and x=4.

The fatty alcohol having oxyethylate moieties will comprise about 0.15 to 5% by weight of the total degreaser composition. More preferably, this component will comprise about 0.17 to 3.3% by weight of the total composition, and most preferably in an amount of about 0.5–2% by weight of the total formulation.

4. The Polyoxyalkylene Block Copolymer of Formula I

The polyoxyalkylene block copolymer is a nonionic surfactant characterized as a block or heteric/block polyoxyalkylene having a cloud point in a 1 weight percent aqueous solution of about 15° C. to about 25° C. having the Formula I:

$$Y[(EO/A)_m(A)_nH]_x \qquad \text{I}$$

wherein, Y represents the nucleus of an active hydrogen-containing organic compound having a functionality of x and (1) about 2 to about 6 carbon atoms and 2 to 3 reactive hydrogen atoms or (2) about 6 to about 18 carbon atoms and 1 to 3 reactive hydrogen atoms; A represents a lower alkylene oxide selected from the group consisting of propylene oxide, butylene oxide, tetrahydrofuran or mixtures thereof wherein up to 25 percent by weight of A is reacted directly with said organic compound either alone in formulas II and III or in admixture with ethylene oxide in Formula I and 75 percent by weight or more of A is subsequently reached to produce said polymer; o is within the range of about 0 to 26, m is within the range of about 0 to 110, and n is within the range of about 0 to 26.

In Formula I, A is preferably oxypropylene or oxybutylene, most preferably, oxypropylene. The molecular weight of Formula I is from about 1,000 to 12,000, most preferably from 1,000 to 5,000, and most preferably from about 1,000 to 2,500.

5. The Polyoxyalkylene Block Copolymer of Formula II $$Y[(A)_o(EO)_m(A)_nH]_x \qquad \text{II}$$

wherein, Y represents the nucleus of an active hydrogen-containing organic compound having a functionality of x and (1) about 2 to about 6 carbon atoms and 2 to 3 reactive hydrogen atoms or (2) about 6 to about 18 carbon atoms and 1 to 3 reactive hydrogen atoms; A represents a lower alkylene oxide selected from the group consisting of propylene oxide, butylene oxide, tetrahydrofuran or mixtures thereof wherein up to 25 percent by weight of A is reacted directly with said organic compound either alone in Formulas II and III or in admixture with ethylene oxide in Formula I and 75 percent by weight or more of A is subsequently reached to produce said polymer; m is within the range of about 0 to 110, and n is within the range of about 0 to 26.

In Formula II, A is preferably oxypropylene or oxybutylene, most preferably, oxypropylene. The molecular weight of Formula II is from about 1,000 to 12,000, most preferably from 1,000 to 5,000, and most preferably from about 1,000 to 2,500. In the most preferred embodiment of Formula II, A is oxypropylene and the molecular weight is about 2,500.

6. The Polyoxyalkylene Block Copolymer of Formula III $$Y[(A)_o(EO/A)_m(A)_nH]_x \qquad \text{III}$$

wherein, Y represents the nucleus of an active hydrogen-containing organic compound having a functionality of x and (1) about 2 to about 6 carbon atoms and 2 to 3 reactive hydrogen atoms or (2) about 6 to about 18 carbon atoms and 1 to 3 reactive hydrogen atoms; A represents a lower alkylene oxide selected from the group consisting of propylene oxide, butylene oxide, tetrahydrofuran or mixtures thereof wherein up to 25 percent by weight of A is reacted directly with said organic compound either alone in Formulas II and III or in admixture with ethylene oxide in Formula I and 75 percent by weight or more of A is subsequently reached to produce said polymer; o is within the range of about 0 to 26, m is within the range of about 0 to 110, and n is within the range of about 0 to 26.

In Formula III, A is preferably oxypropylene or oxybutylene, most preferably, oxypropylene. The molecular weight of Formula III is from about 1,000 to 12,000, most preferably from 1,000 to 5,000, and most preferably from about 1,000 to 2,500.

7. The Alkyl Phenol Alkoxylate Component

The alkyl phenol alkoxylate component has the following Formula:

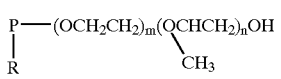

wherein R is a $C_8$ or $C_9$ branched or straight chain alkyl group, m is within the range of about 3 to 12, and n is within the range of about 0 to 12. Preferably the oxyethylate range or value of m will range from about 3 to 12 moles, and more preferably desirably from about 8 to 12 moles. Other oxyalkylation may be incorporated as desired. In the above Formula, P represents a phenyl group.

Preferred alkyl phenol alkoxylates are available from BASF as ICONOL™ OP 10 and ICONOL™ NP4. ICONOL™ OP10 is an octylphenol ethoxylate having a carbon chain length of 8 and an oxyethylate value of 10 moles. The oxypropylate or n value is zero. ICONOL™ NP4 is a nonylphenol ethoxylate with a carbon chain length of 9 and an oxyethylate value of 4.

The alkyl phenol alkoxylate component will make up about 0.15 to 5.0% by weight of the total cleaner composition. More preferably, this component will comprise about 0.17 to 3.3% of the total composition, and even desirably will be present in an amount of about 0.5 to 2% by weight of the total formulation.

The relative ratios of the 2 nonionic surfactants may range from about 1:1 to about 1:2 to about 1:2 and fractional combination thereof (e.g. 0.5:1.5). In a preferred embodiment, there will be equal weight concentrations of each nonionic surfactant component.

The remainder of the degreaser composition will comprise water.

It has also been found that the binary combination of the above combination of nonionic surfactants may optionally contain at least one polycarboxylate based polymer or copolymer further enhances the efficacy of the degreaser composition.

Preferably, the polycarboxylate polymer or copolymer has the following Formula:

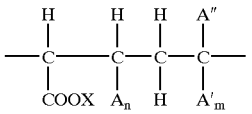

wherein x=H, Na or similar alkali or alkaline metal, A=H, COOH, COONa or similar salts, A' is COOH, COONa, or similar salts, or —$OCH_3$ or an alkyl group having a chain length of about 4 to 20 carbon atoms, A"=H or $CH_3$, and m and n are numbers such that the monomer ratio is within the range of about 10:1 to 1:10 and the total molecular weight of the polymer or copolymer is within the range of about 1,000 to 70,000. (Unless otherwise specified, all molecular weights herein are expressed in terms of weight average molecular weight, or M(w)).

Polyacrylic acid having the above Formula is useful as the polycarboxylate additive. An excellent copolymer having the above Formula is acrylic acid/maleic acid copolymer. Those skilled in the art may also find that certain mixtures of polymers and copolymers according to the Formula heretofore set forth may also may utility as part of the degreaser composition, and therefore these are also within the scope of the invention.

Illustrative methods for preparing the various useful polycarboxylate polymers and copolymers of the invention may be found in Burke et al., U.S. Pat. No. 5,126,068, incorporated herein by reference.

An especially preferred monomer ratio for the polycarboxylate copolymer is about 1:1. A monomeric ratio within the range of about 3:1 to 1:3 is also preferred. A preferred molecular weight range is about 1,000 to 25,000, and even more preferably from about 8,000 to 12,000.

Especially useful copolymers as part of the degreaser composition include the following structures. A polycarboxylate copolymer with a molecular weight of about 12,000, and X=Na, A=COONa, A'=$C_5H_{11}$, A'=$CH_3$ and the monomeric ratio is about 1:1 (Polycarboxylate A in the examples). A polycarboxylate copolymer with a molecular weight of about 70,000, X=Na, A=COONa, A'=$OCH_3$, A'=H and the monomeric ratio is about 1:1. In addition, polyacrylic acid with a molecular weight of about 8,000, where X=Na is also effective as part of the invention. This polyacrylic acid may be obtained from BASF Corp. under the tradename of SOKALAN™ PA 30 CL.

The polycarboxylate polymer or copolymer as part of the invention is added to the degreaser composition in amounts of about 0.005 to 1% by weight based upon the total weight of the composition. Preferably, the polymer or copolymer will comprise from about 0.01 to 0.5% of the total formulation.

The Utility of the Present Invention

The degreaser composition according to the various embodiments of the invention is extremely useful in industrial, institutional, and household cleaning and degreasing of hard surfaces, including but not limited to, glass, ceramic, rigid and flexible hard surfaces and metal, especially automotive parts. The degreaser composition may be applied by methods including but not limited to dipping, soaking, wiping, sonicating, spraying, and especially pressure spray washing. Further, the degreaser composition may be applied at a wide range of temperatures from about 40 to 200° F.

The following non limiting examples illustrate the utility of the present invention:

All percentages are weight percent unless otherwise indicated.

EXAMPLE 1

Meat Packing Equipment Cleaning Composition 1. 0.17 to 3.3% of Component 1—an alcohol alkoxylate with a fatty alcohol moiety having the Formula:

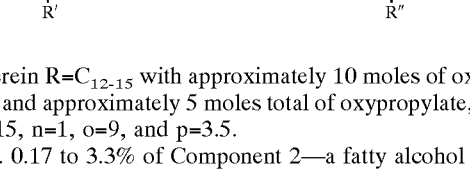

wherein R=$C_{12-15}$ with approximately 10 moles of oxyethylate and approximately 5 moles total of oxypropylate, where m=15, n=1, o=9, and p=3.5.

2. 0.17 to 3.3% of Component 2—a fatty alcohol having the Formula:

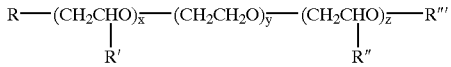

wherein R is $C_{9-11}$ with approximately 9 moles of oxyethylate and one mole of oxybutylate.

EXAMPLE 2

Household Hard Surface Cleaner 1. 0.5 to 2% of Component 1—an alcohol alkoxylate with a fatty alcohol having the Formula:

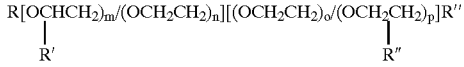

wherein R=$C_{2-15}$ with approximately 10 moles of oxyethylate and approximately 5 moles total of oxypropylate, where m=15, n=1, o=9, and p-3.5.

2. 0.5% to 2.0% of Component 3—a fatty alcohol having oxyethylate moieties having the Formula:

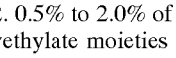

wherein R=13 and x=10.

EXAMPLE 3

Carpet Cleaning Composition 1. 0.5 to 2.0% of Component 1—an alcohol alkoxylate with a fatty alcohol having the Formula:

$$R[\underset{\underset{R'}{|}}{OCHCH_2})_m/(OCH_2CH_2)_n][(OCH_2CH_2)_o/(OCH_2\underset{\underset{R''}{|}}{CH_2})_p]R''$$

wherein R=$C_{12-15}$, with approximately 10 moles of oxyethylate and approximately 5 moles total of oxypropylate, where m=1.5, n-1, o=9, and p=3.5.

2. 0.5 to 2.0% of Component 4—a polyoxylakylene block copolymer of Formula I.

$$Y[(EO/A)_{m(A)n}H]_x \qquad \text{I}$$

wherein A=oxypropylene, and the molecular weight is 1,900.

EXAMPLE 4

Industrial Degreasing Composition 1. 0.17 to 3.3% of Component 1—an alcohol alkoxylate with a fatty alcohol moiety:

$$R[\underset{\underset{R'}{|}}{OCHCH_2})_m/(OCH_2CH_2)_n][(OCH_2CH_2)_o/(OCH_2\underset{\underset{R''}{|}}{CH_2})_p]R''$$

wherein R-$C_{12-15}$, with approximately 10 moles of oxyethylate and approximately 5 moles total of oxypropylate, where m=1.5, n=1, o=9, and p=3.5.

2. 0.17 to 3.3% of Component 5—a polyoxyalkylene block copolymer of Formula II:

$$Y[(A)_o(EO)_m(A)_nH]_x \qquad \text{II}$$

wherein A=oxypropylene and the molecular weight is 2,500.

The preferred diblend compositions are:

1) Component 1+Component 2
2) Component 1+Component 3
3) Component 1+Component 4
4) Component: 1+Component 5
5) Component 1+Component 6
6) Component 1+Component 7

Other useful diblend compositions include, but are not limited to:

1) Component 2+Component 3
2) Component 2+Component 4
3) Component 2+Component 5
4) Component 2+Component 6
5) Component 2+Component 7
6) Component 3+Component 4
7) Component 3+Component 5
8) Component 3+Component 6
9) Component 3+Component 7
10) Component 4+Component 5
11) Component 4+Component 6
12) Component 4+Component 7
13) Component 5+Component 6
14) Component 5+Component 7
15) Component 6+Component 7

While the invention has been described in each of its various embodiments, it is to be expected that certain modifications thereto may be made by those skilled in the art without departing from the true spirit and scope of the invention as set forth in the specification and the accompanying claims.

We claim:

1. An aqueous based solvent free degreaser composition comprising a nonionic surfactant component, wherein said nonionic surfactant component consists of two nonionic surfactants, wherein the first nonionic surfactant is:

0.15%–5% of an alcohol alkoxylate with a fatty alcohol moiety having the Formula:

$$R[\underset{\underset{R'}{|}}{OCH_2CH})_m/(OCH_2CH_2)_n][(OCH_2CH_2)_o/(OCH_2\underset{\underset{R''}{|}}{CH})_p]R'''$$

wherein R is a $C_8$ to $C_{18}$ branched or straight chain alkyl group; the sum of n plus o is from 4 to 12, the sum of m plus p is from 4 to 14; R' is —$CH_3$, —$CH_2CH_3$, or mixtures thereof; R" is —$CH_3$, —$CH_2CH_3$, or mixtures thereof; and R'" is —OH, —$OCH_3$, —O-$C_3$–$C_{18}$ hydroxyalkyl group;

and the second nonionic surfactant is selected from the group consisting of:

(1) 0.15%–5% of a nonionic surfactant characterized as a block or heteric/block polyoxyalkylene having a cloud point in a 1 weight percent aqueous solution of about 15° C. to about 25° C. having the Formula I:

$$Y[(EO/A)_m(A)_nH]_x \qquad \text{(I)}$$

wherein Y represents the nucleus of an active hydrogen-containing organic compound having a functionality of x and (1) about 2 to about 6 carbon atoms and 2 to 3 reactive hydrogen atoms or (2) about 6 to about 18 carbon atoms and 1 to 3 reactive hydrogen atoms; A represents a lower alkylene oxide selected from the group consisting of propylene oxide, butylene oxide, tetrahydrofuran, and mixtures thereof wherein up to 25 percent by weight of A is reacted directly with said organic compound in admixture with ethylene oxide in Formula I and 75 percent by weight or more of A is subsequently reacted to produce said polymer; m is within the range of about 0 to 110, and n is within the range of about 0 to 26, wherein further, the molecular weight range is from about 1,000 to 20,000;

(2) 0.15%–5% of a nonionic surfactant characterized as a block or heteric/block polyoxyalkylene having a cloud point in a 1 weight percent aqueous solution of about 15° C. to about 25° C. having the Formula II:

$$Y[(A)_o(EO)_m(A)_nH]_x \qquad \text{(II)}$$

wherein Y represents the nucleus of an active hydrogen-containing organic compound having a functionality of x and (1) about 2 to about 6 carbon atoms and 2 to 3 reactive hydrogen atoms or (2) about 6 to about 18 carbon atoms and 1 to 3 reactive hydrogen atoms; A represents a lower alkylene oxide selected from the group consisting of propylene oxide, butylene oxide, tetrahydrofuran, and mixtures thereof wherein up to 25 percent by weight of A is reacted directly with said organic compound alone in Formula II and 75 percent by weight of A is subsequently reacted to produce said polymer; o is within the range of about 0 to 26, m is within the range of about 0 to 110, and n is within the range of about 0 to 26, wherein further, the molecular weight range is from about 1,000 to 20,000; and (3) 0.15%–5% of a nonionic surfactant characterized as a block or heteric/block polyoxyalkylene having a cloud point in a 1 weight percent aqueous solution of about 15° C. to about 25° C. having the Formula III:

$$Y[(A)_o(EO/A)_m(A)_nH]_x \quad (III)$$

wherein Y represents the nucleus of an active hydrogen-containing organic compound having a functionality of x and (1) about 2 to about 6 carbon atoms and 2 to 3 reactive hydrogen atoms or (2) about 6 to about 18 carbon atoms and 1 to 3 reactive hydrogen atoms; A represents a lower alkylene oxide selected from the group consisting of propylene oxide, butylene oxide, tetrahydrofuran, and mixtures thereof wherein up to 25 percent by weight of A is reacted directly with said organic compound alone in Formula III and 75 percent by weight or more of A is subsequently reacted to produce said polymer; o is within the range of about 0 to 26, m is within the range of about 0 to 110, and n is within the range of about 0 to 26, wherein further, the molecular weight range is from about 1,000 to 20,000.

* * * * *